US009284671B2

(12) United States Patent
Gläsel et al.

(10) Patent No.: US 9,284,671 B2
(45) **Date of Patent: *Mar. 15, 2016**

(54) TOOL MODULE FOR TEXTILE MACHINE

(71) Applicant: Groz-Beckert KG, Albstadt (DE)

(72) Inventors: Mario Gläsel, Winterlingen/Harthausen (DE); Michael Schink, Winterlingen/Harthausen (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/794,437

(22) Filed: Jul. 8, 2015

(65) Prior Publication Data

US 2015/0308025 A1 Oct. 29, 2015

Related U.S. Application Data

(63) Continuation of application No. 14/132,776, filed on Dec. 18, 2013, now Pat. No. 9,080,270.

(30) Foreign Application Priority Data

Dec. 18, 2012 (DE) ..... 10 2012 112 553

(51) Int. Cl.
*D05C 15/08* (2006.01)
*D05C 15/20* (2006.01)
*D04B 27/06* (2006.01)

(52) U.S. Cl.
CPC ..... *D05C 15/08* (2013.01); *D04B 27/06* (2013.01); *D05C 15/20* (2013.01)

(58) Field of Classification Search
CPC ..... D05C 15/08; D05C 15/20; D05C 15/22; D04B 27/06
USPC ..... 112/80.45–80.51, 80.01, 80.4, 80.6, 112/475.23, 2.2
See application file for complete search history.

(56) References Cited

U.S. PATENT DOCUMENTS 3,757,709 A 9/1973 Cobble
3,857,345 A 12/1974 Higgins
4,817,541 A 4/1989 Magourik
(Continued)

FOREIGN PATENT DOCUMENTS

DE 4223642 A1 11/1993
DE 4411277 A1 10/1994
(Continued)

OTHER PUBLICATIONS

Search Report in corresponding European case EP 13198166, dated Mar. 27, 2014, 3 pages.
(Continued)

*Primary Examiner* — Tejash Patel
(74) *Attorney, Agent, or Firm* — Fitch, Even, Tabin & Flannery LLP

(57) ABSTRACT

A tool module (16) comprises a module body (15) comprising at least two contact surfaces (22, 27). They are separated from one another by means of a groove (30) and one of them extends into the groove (30). A fixed and accurate fit of the tool module (16) on each bar is ensured by means of this groove. Yarn filaments or very fine dirt particles, grout or wear on the accommodations can be accommodated by the groove. In addition, a simple and failure-free assembly is ensured.

14 Claims, 3 Drawing Sheets

(56) References Cited

U.S. PATENT DOCUMENTS

| | | | |
|---|---|---|---|
| 5,295,450 | A | 3/1994 | Neely |
| 5,947,042 | A | 9/1999 | Beyer |
| 5,954,003 | A | 9/1999 | Beyer et al. |
| 6,116,173 | A | 9/2000 | Beyer |
| 6,192,814 | B1 | 2/2001 | Beverly |
| 6,409,030 | B1 | 6/2002 | Schlemper |
| 7,191,717 | B2 | 3/2007 | Green et al. |
| 7,597,057 | B2 | 10/2009 | Johnston et al. |
| 9,080,270 | B2 * | 7/2015 | Glasel et al. |
| 2006/0150882 | A1 | 7/2006 | Johnston |

FOREIGN PATENT DOCUMENTS

| | | | |
|---|---|---|---|
| DE | 29506820 | U1 | 7/1995 |
| DE | 29520281 | U1 | 3/1996 |
| DE | 19928885 | C1 | 3/2001 |
| DE | 10392189 | T5 | 12/2004 |
| GB | 2277328 | A | 10/1994 |

OTHER PUBLICATIONS

Office Action in U.S. Appl. No. 14/132,776, dated Oct. 23, 2014, 7 pages.

* cited by examiner

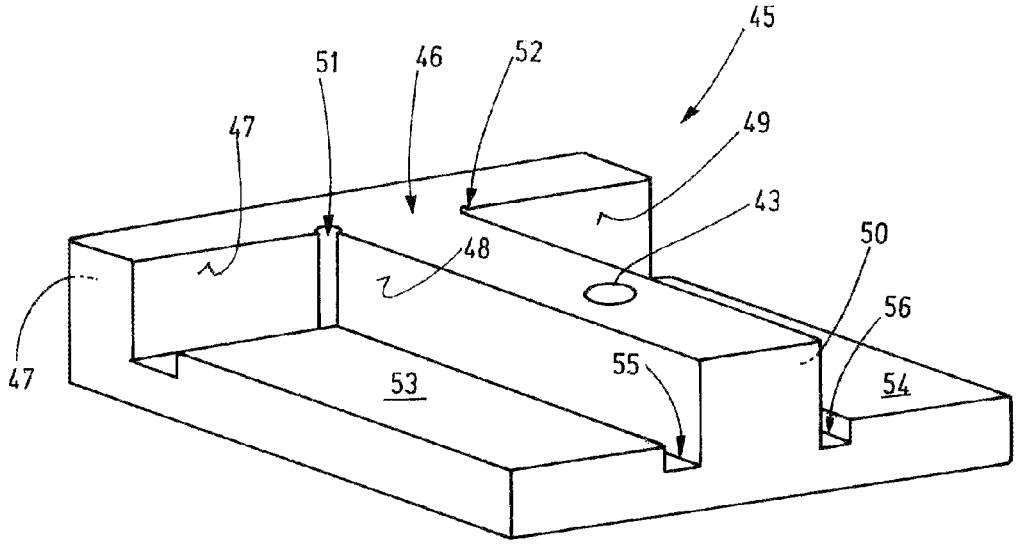
F Fig.9
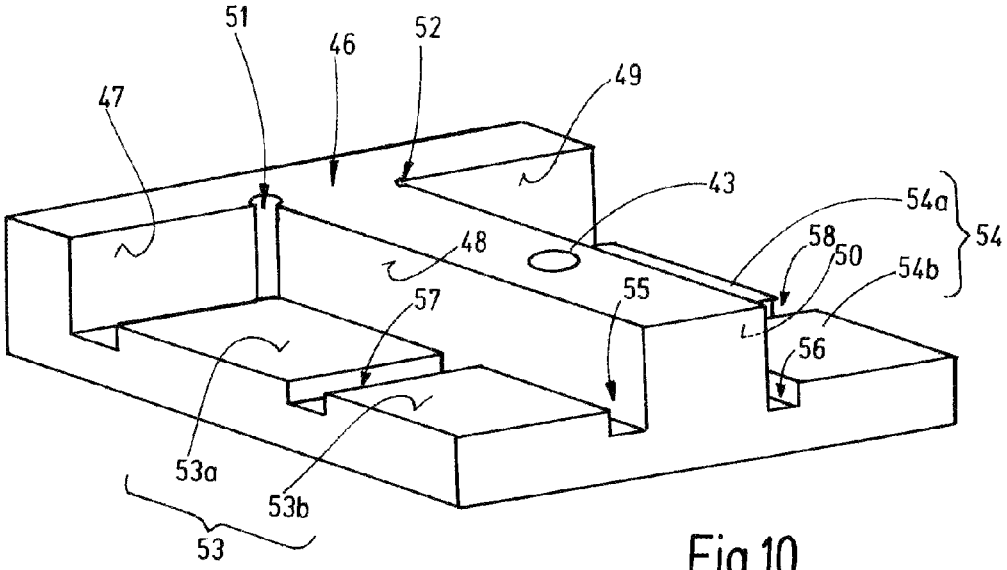
Fig.10

TOOL MODULE FOR TEXTILE MACHINE

This application is a continuation of U.S. patent application Ser. No. 14/132,776, filed Dec. 18, 2013, which claims the benefit of German Patent Application No. 102012112553.8 filed Dec. 18, 2012, the contents of each of which are incorporated herein by reference as if fully rewritten herein.

TECHNICAL FIELD

The invention relates to a tool module for a textile machine, in particular for fastening to a bar of a textile machine, such as a tufting machine or also a knitting machine, for example.

BACKGROUND

The bar of a tufting machine or of a knitting machine supports a large number of tools, such as grippers, needles, guide needles, blades, reed fingers or the like, for example, which are combined in modules in groups. Each module comprises a base body, in or to which a number of tools is fastened. To equip the bar with tools, modules are connected to the bar.

This principle can be gathered from DE 42 23 642 C2 and furthermore from DE 44 11 277 A1, from U.S. Pat. No. 5,947,042 or from DE 199 28 885 C1.

DE 103 92 189 T5 furthermore shows tool modules for fastening to a bar, wherein these tool modules encompass a first, horizontally oriented contact surface, which is embodied on the bottom of a nose, which projects away from a rib on the rear side. Provision is made on both sides of the rib for a second contact surface, which is divided by means of the rib and which is oriented vertically and which is spaced apart from the first contact surface.

SUMMARY

It is a task of the invention to show a way for a more accurate and simpler production of tool modules.

A tool module according to the invention encompasses a module body, to which at least one tool is fastened or can be fastened. The module body furthermore encompasses at least two contact surfaces, which are arranged relative to one another at an angle (e.g. a right angle). The contact surfaces can be embodied so as to be flat or curved. According to the invention, at least one of the two contact surfaces extends into the groove in a straight extension. A production-friendly structure is obtained by means of this measure. For example, the module bodies can be produced in the casting process and can thereby be demolded easily along the contact surface, which extends into the groove. Casting molds, which are embodied in a relatively simple manner, can be used to produce the module bodies.

In addition, the proposed embodiment of the groove facilitates an accurate production of the modules. In particular, the special arrangement of the groove benefits the flatness of the contact surface, which connects to the groove. This is in particular the case, when the contact surface, which, of the two contact surfaces, which are separated by the groove, has the smaller area, is determined as that contact surface, which extends into the groove in a straight extension. This applies in particular in response to the production of module bodies of pourable metals, such as aluminum, zinc, or the alloys thereof a well as of plastic or a plastic composite. In particular, it is preferred for the groove to surround the larger one of the contact surfaces at least on two sides. With regard to the cool-down and shrinking behavior of the used materials, this can increase the flatness of the contact surface.

At least one of the contact surfaces is preferably a plane surface. The contact surface can be embodied so as to be connected or so as to be divided. For example, the groove, which runs along the edge of the contact surface, can be branched and can encompass branches, which divide the plane surface into partial surfaces. The partial surfaces can be connected to one another or can be divided completely by means of the branch of the groove.

The contact surface can also be a curved surface, for example a cylindrical surface, a truncated cone-shaped surface or the like. In the case of a truncated cone-shaped surface, the cone angle is preferably small, for example smaller than 5°.

The module body is preferably a cast body, for example an injection molded body, for example of a metal. The groove can encompass a rectangular, square or trapezoidal cross section. The corners of this cross section can be rounded. Such cross sections lead to a groove comprising a flat, that is, non-rounded base. Preferably, this flat base is arranged parallel to at least one of the contact surfaces. This results in a clearly arranged structure, which is free from undercuts and releases the contact surfaces to the extent that the module body is subject to minimal deformation in response to cooling down.

The groove can encompass two shoulders, which are located opposite one another. They are preferably oriented parallel to one another or they draw an acute angle between one another, which opens away from the groove. This results in a structure, which is free from undercuts, which makes it possible to demold the module body easily even in the case of particularly simple molds comprising few or no movable parts.

The module body can be embodied smoothly in one piece, so that the contact surfaces are embodied on the same body. However, it is also possible to design the module body in two or more pieces, in that provision is initially made for a base body, into which an arrangement element is inserted. The arrangement element can be cast into the base body or can be fastened therein in a different manner. While the one contact surface is embodied on the base body, the other contact surface is preferably embodied on the arrangement element. The arrangement element can be a pin, a journal with or without a head, an ashlar-formed body or a different body. It can be arranged in the casting mold for the module body and can thus be connected to the cast base body during the casting.

BRIEF DESCRIPTION OF THE DRAWINGS

Further details of advantageous embodiments of the invention follow from the drawing, the description or claims.

FIGS. 7 and 8 show further embodiments of the tufting module similar to FIG. 2 in a perspective illustration in sections and FIGS. 9 and 10 show further embodiments of a tool module for fastening to a bar in perspective illustration.

DETAILED DESCRIPTION

Figure 1:
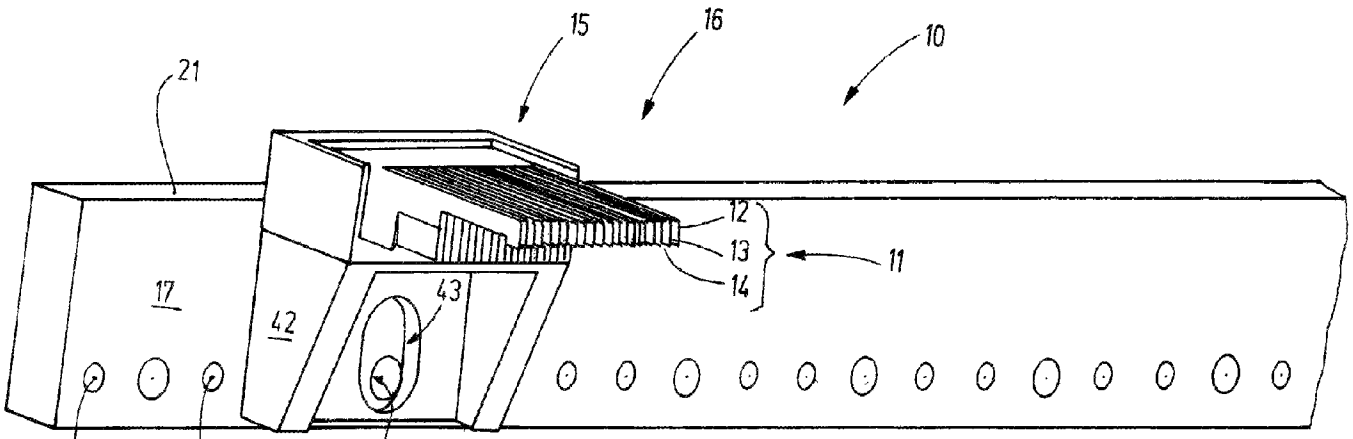
FIG. 1 shows a bar of a tufting machine comprising a gripper module, which is fastened thereto, in a schematized perspective illustration.

FIG. 1 illustrates a bar 10, as it is present in textile machines, for example tufting machines or also knitting machines. The bar of a tufting machine is illustrated herein in an exemplary manner. The following embodiments, however, apply accordingly for knitting machines or other textile machines, for example stitch-bonding machines or the like, which encompass moved bars, by means of which tools 11 are moved together. Loop grippers 12, 13, 14, which are held on a common module body 15 and which form a tool module 16 with the latter, are located on the bar 10 in FIG. 1 as tools 11. The tool module 16 can hold one, a plurality of or also many tools 12 to 14, depending on fineness and work task. The tools 12 to 14 are embodied in a common manner. As is illustrated, they can be grippers, but also any other tool, such as guide needles, feeders, needle, reed fingers or the like.

The module body 15 is equipped to come into contact with the positioning surfaces of the bar 10 so as to fit appropriately. Positioning surfaces can be a front plane surface 17, for example, or also cylindrical wall surfaces 18, 19, 20 (FIG. 3) of boreholes, which are attached in the bar 10. Further surfaces of the bar 10, such as the upper narrow side 21 thereof, for example, can also serve as positioning surfaces.

Figure 2:
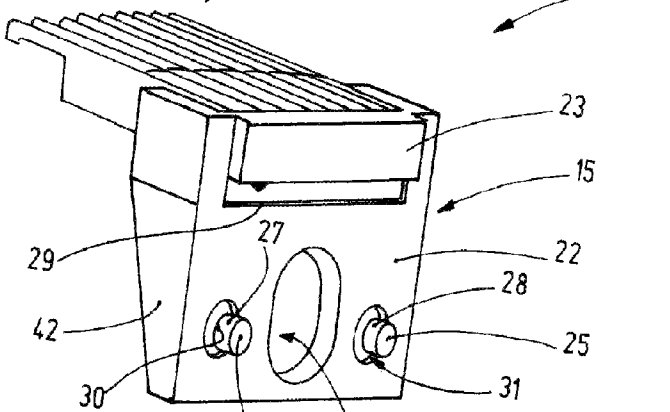
FIG. 2 shows the gripper module according to FIG. 1 in perspective illustration with illustration of the rear side thereof.
Figure 3:
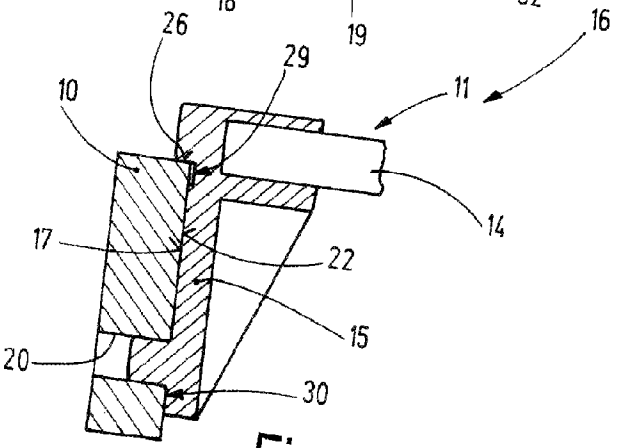
FIG. 3 shows the bar and the tufting module according to FIG. 1, in a vertical sectional illustration in sections.

As can be seen from FIGS. 2 and 3, the module body 15 encompasses a flat contact surface 22, which is provided for coming into contact with the plane surface 17. The first flat contact surface 22 is embodied on the rear side of the module body 15, which faces the bar 10, so as to come into contact with the plane surface 17.

On its rear side, the module body 15 encompasses further contact surfaces. They can be embodied, for example, on a rectangular projection 23 and/or on one or a plurality of journals 24, 25, which project away from the rear side. In the case of the rectangular projection 23, a contact surface 26 can be embodied as a flat surface on a bottom side, which is covered in FIG. 2, but which can be seen from FIG. 3, which is located at an angle, for example a right angle, to the contact surface 22. The journals 24 and/or 25 can encompass contact surfaces 27, 28 on their cylindrical or truncated cone-shaped jackets.

The tool module 16 according to the invention is characterized in that at least two contact surfaces 22, 26 and/or 22, 27 and/or 22, 28 are separated from one another by a groove 29, 30, 31 (FIG. 2). The respective groove 28 to 31 is thereby preferably embodied such that it completely separates the respective contact surface pair from one another.

For example, the module body 15 consists of a metal, for example zinc die casting. However, it can also be made of aluminum die casting, plastic die casting, plastic composite or a different material. Preferably, it is produced in a corresponding casting process. However, other production processes, which cannot be assigned to the master forming, but to the forming or machining, are also possible. Incorrect positionings are avoided by means of the groove 29 to 31 and it is ensured that the contact surface 22 comes into a holohedral secure contact with the plane surface 17. It is furthermore ensured that the tool modules 16 can be removed easily from the bar 10, when a fastening screw is unscrewed from the fastening opening 32, which is illustrated in FIG. 1.

Figure 4:
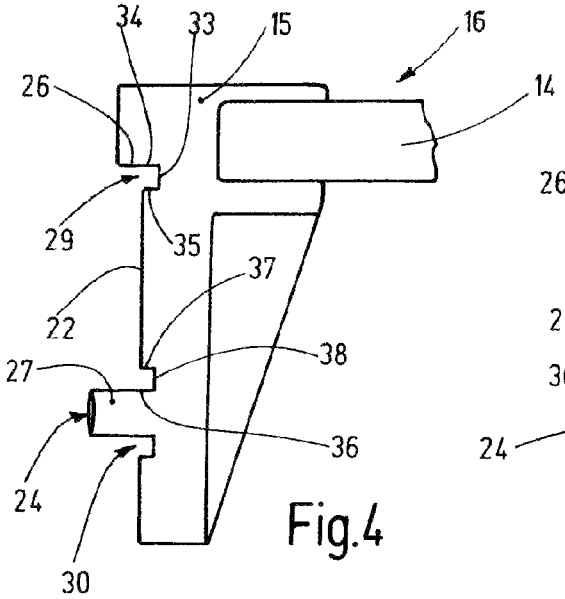
FIGS. 4 to 6 show the tufting module according to FIG. 2 in different embodiments, in each case cut vertically.

FIG. 4 illustrates the tool module 16 according to FIG. 3 once again by omitting the hatching for further clarification and explanation. As can be seen, the tool 14 is embedded into the module body 15, for example cast into it. The grooves 29, 30 (31) are square grooves in this case. As can be seen by means of the example of the groove 29, a first flat shoulder 34 and a further flat shoulder 35 located opposite thereto connects to a flat groove base 33. The smaller contact surface 26 merges into the first shoulder 34 in a flush and straight manner and thus extends into the groove 29. In contrast, the second, larger contact surface 22 draws an angle with the shoulder 35, which joins it, for example a right angle or also a slightly larger, slightly acute angle. Viewed from behind (vertically onto the flat contact surface 22), the groove 29 is thus free from undercuts. The groove 29 can be produced very easily in the casting process, without requiring movable molded parts.

Likewise, the contact surface 27 extends into the groove 30 and forms a journal-side shoulder 36 of the groove 30 in the groove 30. A further ring-shaped shoulder 37 is arranged so as to be located opposite the ring-shaped shoulder 36. A preferably flat base 38 is arranged between the shoulders 36, 37. The base 38 can be oriented parallel to the contact surface 22. It can also be embodied in a truncated cone-shaped manner and can rise towards the journal 24, for example.

A minimal elastic resilience of the journal 24 can be effected by means of the groove 30, so as to prevent a jamming of the tool module 16 on the bar 10, in particular when using two journals 24, 25, and, on the other hand, to nonetheless provide for a play-free fit of the contact surface 27, 28 in corresponding positioning holes of the bar 10.

The cross sections of the grooves 29, 30 are illustrated as virtually square rectangles in FIG. 4. As already mentioned, the cross sections can deviate from this shape. In particular, however, it is also possible to provide the base 33, 38 with a concave curvature. The same applies to the groove 31.

Figure 5:
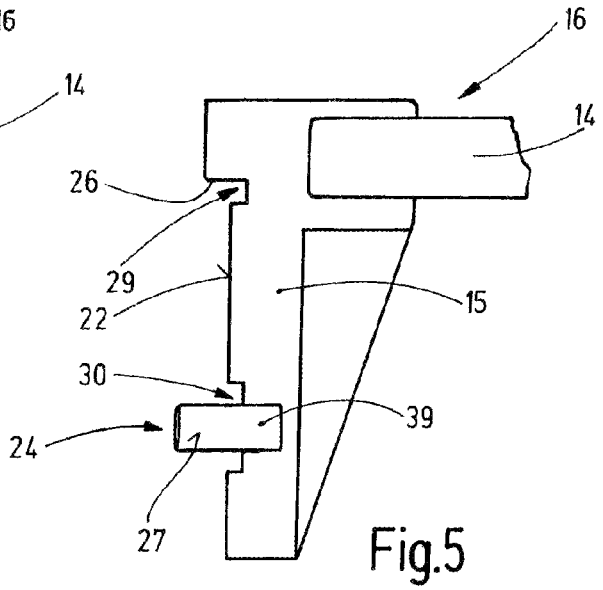

According to FIG. 4, the module body 15 is embodied smoothly in one piece from the same material. However, it can also consist of a plurality of parts, as is shown in FIG. 5. By maintaining the geometry of the contact surfaces 22, 26, 27 as well as of the groves 39, 30 (31), the journal 24 (25) can be embodied as a separate arrangement element 39. This can be a steel pin or the like, for example, which is cast with the module body 15.

The journal can also be connected to the module body 15 in a different manner, for example by injection, screwing in, gluing in, welding in, soldering in or the like.

Figure 6:
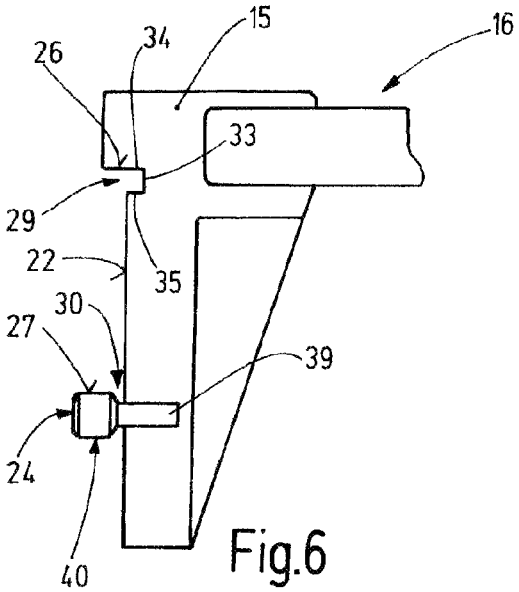

A modified embodiment is shown in FIG. 6. This differs from the embodiment according to FIG. 5 in particular in the embodiment of the arrangement element 39, but otherwise corresponds to FIG. 5, which is why the above description applies accordingly, taking all of the explained modifications into account. The arrangement element 39 encompasses a head 40, on which the contact surface 27 is embodied. A shaft 40, which projects into the module body 15 and which is anchored therein, extends away from the cylindrical head 27. The groove 30 is now radially open, while it was axially open in the case of the above-described embodiments. An undercut results downstream from the head 40. The contact surface 22 extends into the groove 30. While, in contrast to the previous embodiments, said contact surface cannot contribute now to the relaxation of the contact surface 22 in response to cooling down the module body 15 from the casting heat, it nonetheless effects an increase of the resilience of the journal 24 in radial direction and thus contributes to the appropriate fit of the tool module 16 on the bar 10 without increasing jamming tendencies caused by production tolerances.

Figure 7:
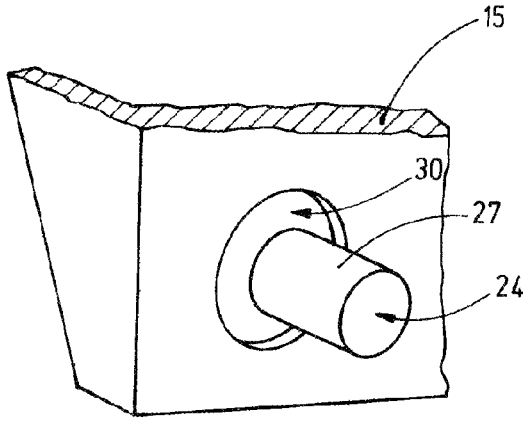

FIG. 7 illustrates a further embodiment, based on the embodiment according to FIG. 4. The groove 30 is embodied herein so as to be particularly flat. Otherwise, the previous description applies accordingly. It is pointed out that, following FIG. 4, the journal 24 can be a one-piece part of the module body 15 or, following FIG. 5, it can, in the alternative, also be inserted into said module body as a separate element. In addition, the journal 24 can be embodied so as to be staged, as it suggested in FIG. 6.

Figure 8:
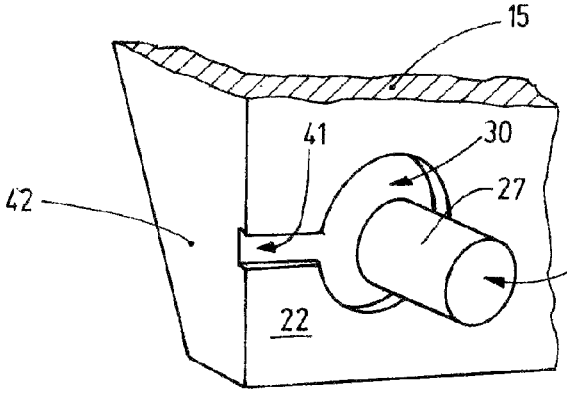

FIG. 8 illustrates that, irrespective of its cross sectional shape, the groove 30 must not necessarily be embodied as closed ring, but can also be branched. At least one branch 41, which can extend up to a side surface 42 of the module body 15, branches off from the groove 30. The branch 41 thus severs the contact surface 22 at least on one side of the journal 24. The contact surface 22 is thus embodied so as to still be partially connected. However, further branches can branch off from the groove 30 and can lead to the central fastening opening 43 (FIG. 2) or can extend up to the other groove 31 and/or the groove 29. The contact surface 22 can thus be divided partially or once or also several times. The latter leads to an increased relaxation of the contact surface 2 in response to the cool-down of the module body 15 from its casting heat.

As is illustrated in FIG. 9, the principle of using a groove between different contact surfaces can also be used in the case of module bodies, which are shaped entirely different, or in the case of adapter bodies for use on bars 10. FIG. 9 illustrates a module body 45 comprising a T-shaped projection 46, which fits into corresponding recesses of a bar (not illustrated). On a side 47, which faces away from the observer in FIG. 9, one or a plurality of tools can be attached. The T-shaped projection 46 of the module body 45 can encompass contact surfaces 47, 48 as well as 49, 50, which are positioned at an angle or at a right angle to one another, respectively, and which are adjacent to one another in pairs and which are in each case separated from one another by means of a groove 51, 52. These grooves are free from undercuts, for example viewed parallel to the respective grooves 51, 52. In these cases, however, none of the contact surfaces 47 to 50 must extend into the respective groove 51, 52, whereby it is also possible that at least one of the contact surfaces 47, 48 extends into the groove 51 in a straight extension. The same applies to the groove 52 and to the contact surfaces 49, 50.

Provision can be made on both sides of the T-shaped projection 46 for contact surfaces 53, 54, which are preferably located in a common plane. The contact surface 53 is separated and spaced apart from the contact surface 47 as well as from the contact surface 48 by means of a groove 55. Accordingly, a groove 56 separates and spaces the contact surface 54 apart from the contact surfaces 49, 50. The contact surfaces 47, 48 extend into the groove 55 in a straight extension. The contact surfaces 49, 50 extend into the groove 56 in a straight extension. With regard to the cross sectional shape and the function of the grooves 55, 56, reference is made to the previous description and to the effect in particular of the grooves 29, 30, 31. These explanations apply accordingly herein. In addition, it is pointed out that the grooves 55, 56 can be branched, as is illustrated in FIG. 10. A corresponding branch 57 of the groove 55 can divide the contact surface 53, so that two rectangular or square partial surfaces 53*a*, 53*b* are created, for example. The same applies to the contact surface 54, which can encompass partial surfaces 54*a*, 54*b*, which are separated from one another by means of a corresponding branch 58 of the groove 56.

With regard to the grooves 57, 58, the explanations made with regard to the remaining grooves apply as well.

A tool module 16 comprises a module body 15, comprising at least two contact surfaces 22, 27. They are separated from one another by means of a groove 30 and one of them extends into the groove 30. A fixed and accurate fit of the tool module 16 on each bar is ensured by means of this groove. Yarn filaments or very fine dirt particles, grout or wear on the accommodations can be accommodated by the groove. In addition, a simple and failure-free assembly is ensured.

LIST OF REFERENCE NUMERALS

10 Bar
11 Tools
12-14 loop grippers
15 module body
16 tool module
17 plane surface
18-20 wall surfaces
21 upper narrow side of the bar 10
22 flat contact surface
23 rectangular projection
24, 25 Journals
26-28 contact surfaces
29-31 groove
32 fastening opening
33 base
34 first shoulder
35 second shoulder
36 first ring-shaped shoulder
37 second ring-shaped shoulder
38 base
39 arrangement element
40 shaft
41 branch
42 side surfaces
43 fastening opening
45 module body
46 projection
47-50 contact surfaces
51, 52 groove
53, 54 contact surface
53*a*, 53*b* partial surfaces
54*a*, 54*b*
55, 56 groove
57, 58 branch

What is claimed is:

1. A tool module (16) for fastening to a bar (10) of a textile machine, the module comprising:

a module body (15), on which at least one tool (14) is held or can be fastened and which encompasses at least two contact surfaces (22, 27) disposed to contact a bar (10) of a textile machine when the module body (15) is mounted to the bar (10), which are arranged relative to one another at an angle and which are separated from one another by a groove (30);

wherein the groove includes at least two grooves disposed on at least two sides of a larger one of the at least two contact surfaces wherein at least two of the at least two grooves separate different contact surfaces of the at least two contact surfaces arranged relative to one another at an angle.

2. The tool module according to claim 1, wherein at least one of the at least two contact surfaces (22, 27) is a plane surface.

3. The tool module according to claim 1, wherein at least one of the at least two contact surfaces (22, 27) is a curved surface.

4. The tool module according to claim 3, wherein the curved contact surface (27) is a cylindrical surface or a truncated cone-shaped surface.

5. The tool module according to claim 1, wherein the module body (15) is a cast body.

6. The tool module according to claim 1, wherein the module body (15) is a metal.

7. The tool module according to claim 1, wherein the groove (9) encompasses a flat base (33).

8. The tool module according to claim 7, wherein the base (33) is arranged parallel to one of the contact surfaces.

9. The tool module according to claim 7, wherein the base (33) is arranged parallel to one of the at least two contact surfaces (22), which one comprises a flat contact surface.

10. The tool module according to claim 1, wherein the groove (29) encompasses two shoulders (34, 35), which are located opposite one another and parallel to one another.

11. The tool module according to claim 1, wherein the groove (29) encompasses a width, which is maximally as large as its depth.

12. The tool module according to claim 1, wherein the groove (29) is embodied so as to be free from undercuts, viewed parallel to a fastening opening (43).

13. The tool module according to claim 1, wherein the module body (15) is embodied smoothly in one piece.

14. The tool module according to claim 1, wherein the module body (15) encompasses a base body, on which at least one of the contact surfaces (22, 27) is embodied, and in that an arrangement element (39), on which another one of the contact surfaces (22, 27) is embodied, is inserted into the base body.

* * * * *